United States Patent [19]

Sakamoto et al.

[11] Patent Number: 4,901,696

[45] Date of Patent: Feb. 20, 1990

[54] IGNITION TIMING CONTROL SYSTEM FOR INTERNAL COMBUSTION

[75] Inventors: Osamu Sakamoto; Kazuhiro Nakamura, both of Hamamatsu, Japan

[73] Assignee: Sanshin Kogyo Kabushiki Kaisha, Hamamatsu, Japan

[21] Appl. No.: 183,678

[22] Filed: Apr. 19, 1988

[30] Foreign Application Priority Data

Apr. 20, 1987 [JP] Japan ..... 62-095201

[51] Int. Cl.[4] ..... F02P 5/02

[52] U.S. Cl. ..... 123/413

[58] Field of Search ..... 123/329, 413, 418, 422, 123/423

[56] References Cited

U.S. PATENT DOCUMENTS

| | | | |
|---|---|---|---|
| 3,855,985 | 12/1974 | Shirai | 123/413 X |
| 4,528,953 | 7/1985 | Flaig et al. | 123/413 |
| 4,602,602 | 7/1986 | Donohue | 123/413 |
| 4,612,899 | 9/1986 | Honjoh et al. | 123/413 |
| 4,747,381 | 5/1988 | Baltz et al. | 123/413 |

FOREIGN PATENT DOCUMENTS

| | | | |
|---|---|---|---|
| 0115854 | 9/1981 | Japan | 123/413 |
| 0030432 | 2/1985 | Japan . | |

*Primary Examiner*—Willis R. Wolfe

*Attorney, Agent, or Firm*—Ernest A. Beutler

[57] ABSTRACT

An ignition timing control system for an internal combustion engine including a throttle position sensor and a translational mechanism for transmitting movement of the throttle valve into a desired movement of the throttle position sensor so as to achieve variations in the spark advance angle without necessitating reconfiguration or recalibration of the ignition circuit.

7 Claims, 6 Drawing Sheets

IGNITION TIMING CONTROL SYSTEM FOR INTERNAL COMBUSTION

BACKGROUND OF THE INVENTION

This invention relates to an ignition timing control system for internal combustion engines and more particularly to an improved ignition timing control system that lends itself to adjustment and application to a variety of engines and engine types.

It has been known to provide a mechanical ignition timing control for internal combustion engines wherein the spark advance is adjusted mechanically in response to changes in position of the carburetor throttle valve. Such an arrangement is shown in Japanese published application SHO No. 60-30432. As shown in that application, there is an ignition advance system for an internal combustion engine as applied in an outboard motor wherein a mechanical linkage system interconnects the throttle valves of the carburetors with a rotatably journaled plate carrying a pulser coil that cooperates with a rotating magnet carried by the engine flywheel for achieving adjustment in timing. Although this type of arrangement has considerable advantages, there are also some disadvantages. For example, the rotational support for the pulser coil and the associated structure adds to both the size and weight of the engine. Also, with a mechanical system of this type it is difficult to provide the optimum ignition timing under all engine running characteristics.

To offset the deficiencies of the mechanical spark timing adjustment, it has been proposed to provide an electronic system wherein a sensor senses the condition of the throttle valves and then that sensed throttle valve condition is transmitted to an advance angle arithmetic circuit that electronically changes the advance angle (IT) of the spark timing in accordance with the angular position of the throttle valve (Th$\theta$).

although the electronic system as described has a number of advantages over the mechanical system, it itself has several disadvantages. For example, if changes in tuning of the spark timing relative to the throttle position are required, it is necessary to provide a completely new electronic module or a substantial component of it. Also, this makes it difficult to change the spark timing in response to geographic characteristics or to adapt a given ignition system to engines of different types.

It is, therefore, a principal object of this invention to provide an improved ignition timing circuit for an internal combustion engine.

It is a yet further object of this invention to provide an electronic ignition timing control that provides and permits adjustment for a wide variety of factors without changing the electronic components.

it is a still further object of this invention to provide an electronic timing control system that permits simple mechanical adjustment.

SUMMARY OF THE INVENTION

This invention is adapted to be embodied in an ignition control system for an internal combustion engine having an engine speed controlling element moveable through a predetermined range for controlling the engine speed, position sensing means for sensing the position of said speed controlling element and an ignition circuit for controlling ignition timing including arithmetic advancing means moveable in a predetermined range for controlling the ignition timing in response to the signal of the position sensing means. In accordance with the invention, means are provided for translating the movement of the speed controlling element into movement of the position sensing means at a predetermined ratio.

DETAILED DESCRIPTION OF THE PREFERRED EMBODIMENTS OF THE INVENTION

Figure 1:
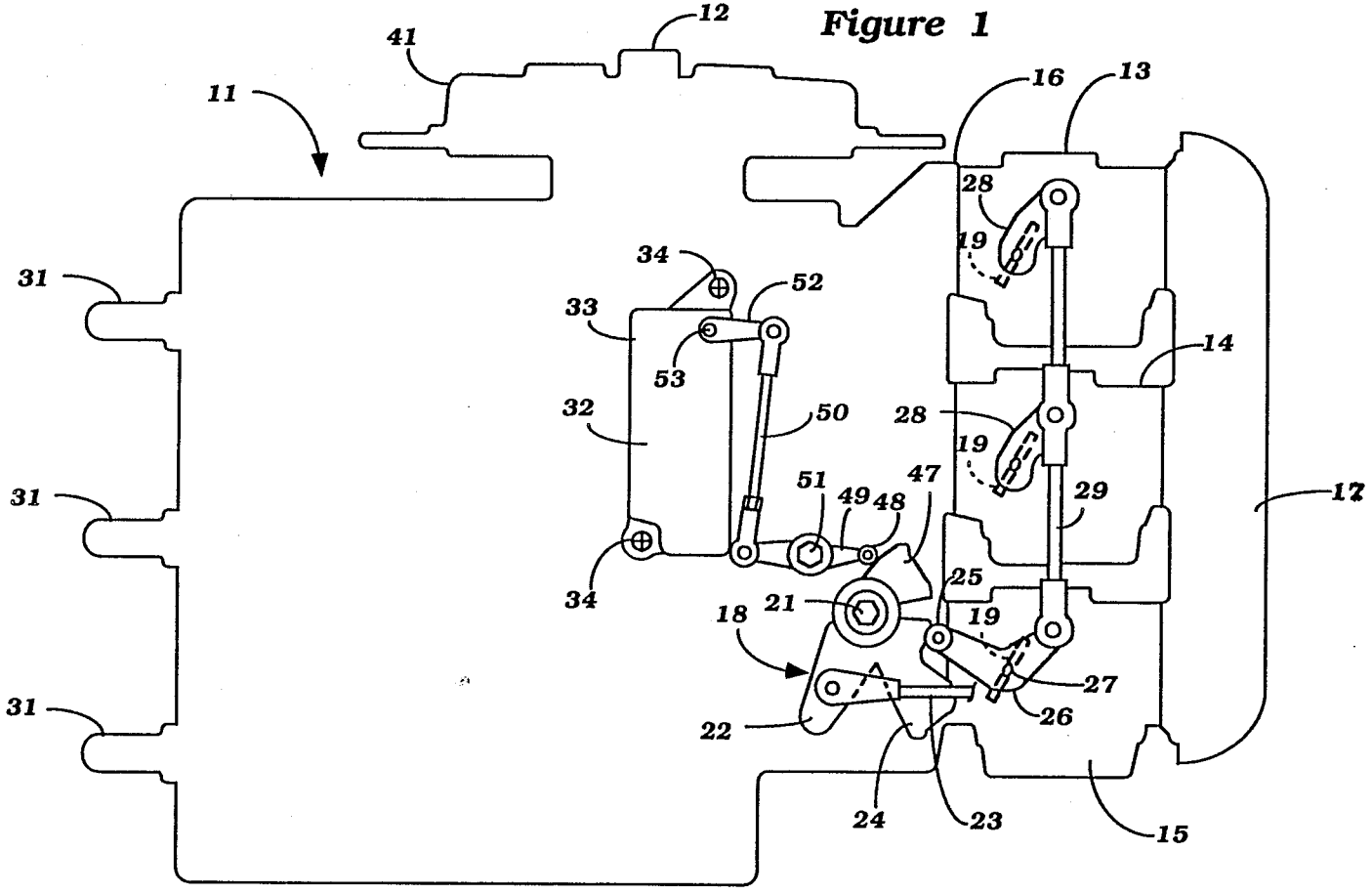
FIG. 1 is a side elevational view of an internal combustion engine, forming a component of an outboard motor, and constructed in accordance with an embodiment of the invention.

Referring first in detail to FIG. 1, an internal combustion engine constructed in accordance with an embodiment of the invention is identified generally by the reference numeral 11. The engine 11 is particularly adapted for use in outboard motors and, for that reason, has its output shaft or crankshaft 12 rotatable about a generally vertically disposed axis. In the illustrated embodiment, the engine 11 is of the three cylinder, two cycle crankcase compression type and includes three carburetors 13, 14 and 15 each of which supplies a fuel air mixture to the individual crankcase chambers of the engine through a manifold 16. An air inlet device 17 is affixed to the carburetors 13, 14 and 15 so as to provide a source of silenced air to them.

The construction of the engine as thus far described may be considered to be conventional and since the invention relates primarily to the ignition system for the engine 11 further details of the construction of other components of the engine are not believed to be necessary in order to understand the invention. Also, it is to be understood that the invention is adapted to be used with engines of other than the two cycle type and engines having different numbers of cylinders and cylinder configuration. In fact, the invention may also be employed with rotary type engines.

An engine speed controlling system including a throttle controlling cam 18 is incorporated for controlling the position of throttle valves 19 of the carburetors 13, 14 and 15 and, accordingly, the speed of the engine 11.

The throttle controlling cam 18 is supported for rotation about a horizontally disposed axis on a pivot bolt 21. The cam 18 has a first lever arm 22 that is connected to a throttle valve control 23 for rotating the cam 18 under an operator's control. The throttle control 23 is connected in a suitable manner to a remotely positioned operator (not shown).

The cam 18 is provided with a first lobe 24 that cooperates with a follower 25 that is carried on one arm of a bell crank throttle lever 26. The throttle lever 26 is connected to the throttle valve shaft 27 of the lower most carburetor 15. The throttle lever 26 is also connected to throttle levers 28 of the remaining carburetors 13 and 14 by means of a linkage system 29. The throttle levers 28 are affixed to the throttle valve shafts of the carburetors 13 and 14 so that all of the throttle valves of the carburetors 13, 14 and 15 will be operated in unison.

Figure 2:
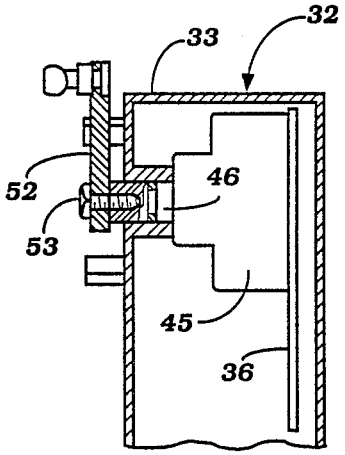
FIG. 2 is a cross-sectional view taken along the line 2—2 of FIG. 1 and showing an enlarged portion of this embodiment.
Figure 4:
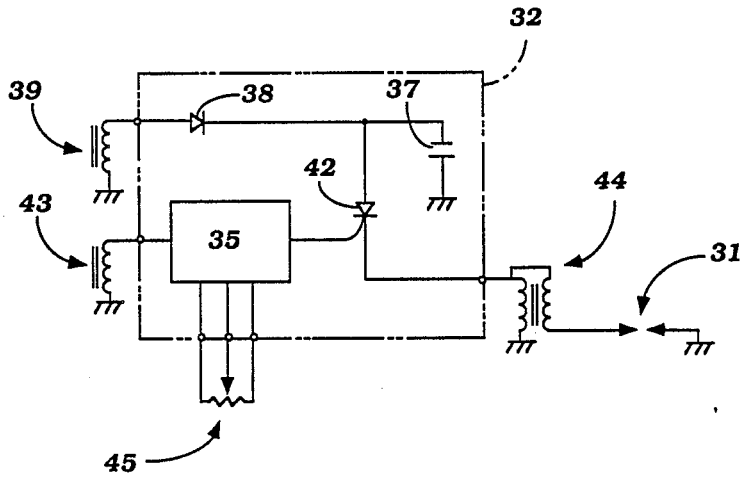
FIG. 4 is an electrical schematic diagram of the embodiment.

The engine 11 is also provided with an ignition system comprised of spark plugs 31 for each of the cylinders of the engine 11. The spark plugs 31 are fired by means of an ignition control system, indicated generally by the reference numeral 32 and contained as a unit in a spark box 33 that is affixed to a side of the engine, by fasteners 34. Accept as hereinafter noted, the spark control system 32 is fully electronic and incorporates an arithmetic advancing mechanism 35 9FIG. 4).

the ignition control circuit is mounted on a circuit board 36 that is contained within the spark box 33 (FIG. 2) and which is shown schematically in FIG. 4. As seen in FIG. 4, the circuit is of the SCR type and includes a firing capacitor 37 that is charged through a diode 38 from a charging coil 39 that is associated with a magneto generator 41 (FIG. 1) that is affixed to the upper end of the crankshaft 12. A control SCR 42 is switched by means of the arithmetic advancing means 35 which is triggered by a pulser coil 43 that is also fixed in proximity to the magneto generator 41.

The pulser coil 43 gives a fixed output at a predetermined crankshaft angle and the arithmetic advancing circuit 35 will, in accordance with its preprogrammed relationship, switch the SCR 42 to permit the charge capacitor 37 to discharge through the primary winding of a spark coil 44. This induces a voltage in the secondary coil which discharges through the gap of the spark plug 31 for firing it. The ignition circuit for only a single of the spark plugs is illustrated and it is believed that those skilled in the art will readily determine how the system can be applied to multiple spark plugs.

The arithmetic advancing circuit 35 receives an input signal from a throttle position sensor 45 that is depicted as being of the variable resistor type but which may be of any other known type so as to provide an input signal indicative of the position of the throttle valves 19. The throttle position sensor 45 includes an input shaft 46 that is operated by means of a translational system that mechanically interconnects the throttle valves 19 with the shaft 46 so as to permit adjustment and modification for tuning and other purposes as aforedescribed.

This mechanism includes a throttle position sensing cam 47 that is fixed to and forms another arm of the throttle controlling cam 18. The cam 47 cooperates with a roller follower 48 that is affixed to one arm of a bell crank 49 which is journaled for rotation on the engine by means of a pivot bolt 51. The rotational axis of the bell crank 49 is parallel to and adjacent that of the throttle controlling cam 18. An adjustable link 52 interconnects the other arm of the throttle positioning bell crank 49 with a lever arm 52 that is adjustably affixed to the throttle position sensor shaft 46 by means of a clamping bolt 53. It is to be understood that other arrangements may be incorporated for achieving this adjustable connection and certain additional embodiments will be described.

The clamping bolt 53 may be used to clamp the lever 52 to the shaft 46 when the carburetor throttle valves 19 are in their idle position by moving the arm 52 into engagement with an idle stop 54 in this throttle position and then locking the clamping bolt 53 in position. Alternatively, the arm 52 may be affixed in the full throttle position by moving it against a fixed stop 55 and locking the clamping bolt 53 in position when the carburetor throttle valves 19 are fully open. Of course, either or both of the stops 54 and 55 may be adjustable rather than fixed.

Figure 5:
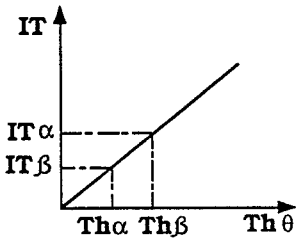
FIG. 5 is a graphical view showing the relationship between the ignition advancing angle (IT) and the throttle angle (TH$\theta$).
Figure 6:
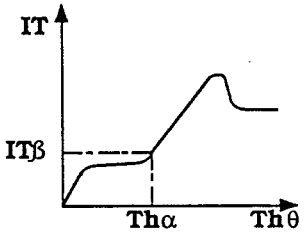
FIG. 6 is a graphical view, in part similar to FIG. 5, showing a detailed view of how the ignition angle can be set as desired.

The way in which the arithmetic advancing means 45 functions may be understood by reference to FIG. 5 with the effect of the translating mechanism for rotating the shaft 46 being understood by reference to FIG. 6. In each of these figures, throttle valve position (TH$\theta$) is shown on the ordinate while spark advance (IT) is shown on the abscissas. The ignition advancing angle means 35 is basically a linear device so that at a position TH$\alpha$ there is the advance IT$\alpha$ and at the throttle position TH$\beta$ there is the advance angle IT$\beta$. Thus, it should be readily apparent that the conventional systems do not offer any way of achieving adjustment in the shape of the output curve to suit individual performances. However, with the translational mechanism including the shape of the cam 47 and the ratios of mechanical advantages of the levers consisting of the bell crank 49, link 50 and lever 52 it is possible to achieve any desired curve of advance angle relative to spark advance angle as shown in FIG. 6. As shown in this figure, at the point TH$\alpha$ it is possible to obtain the ignition advance IT$\beta$ etc. Any desired configuration can be achieved by changing the mechanical linkage system and or adjustment of its initial position.

Figure 3:
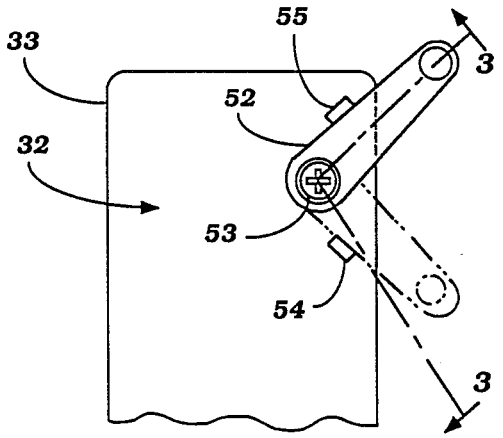
FIG. 3 is an enlarged side elevational view of the embodiment.
Figure 7:
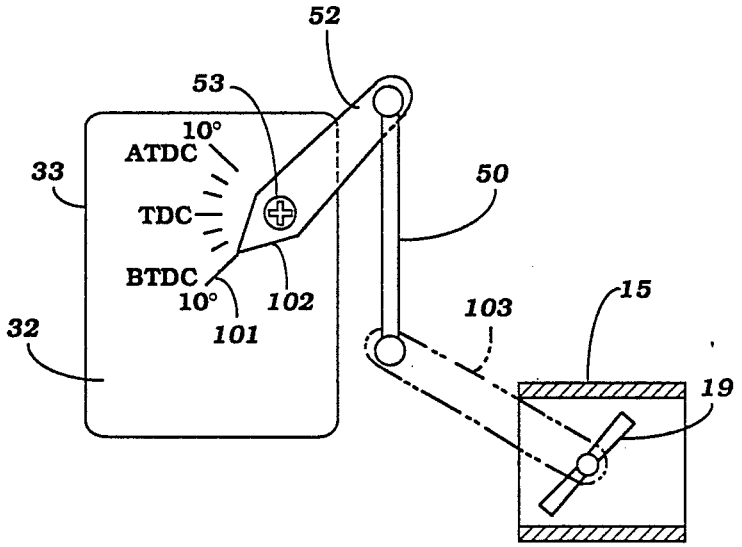
FIG. 7 is a side elevational view, in part similar to Figure 3, showing another embodiment of the invention.

FIG. 7 shows another embodiment of the invention wherein the relationship between the position of the throttle valve 19 and the input shaft 46 of the arithmetic advancing means 45 can be adjusted other than by using fixed or adjustable stops as shown in FIG. 3. In this embodiment, the housing 33 of the spark box 32 is provided with a suitable legend 101 indicative of ignition advance angle of the advancing mechanism 45. The lever 52 is provided with a pointer portion 102 so that the clamping bolt 53 may be locked in position at the desired advance angle of the ignition for the given position of the throttle valve 19. The translational mechanism comprised of the cam 47, follower 48 and bell crank 49 is indicated schematically at 103 in this figure.

Figure 8:
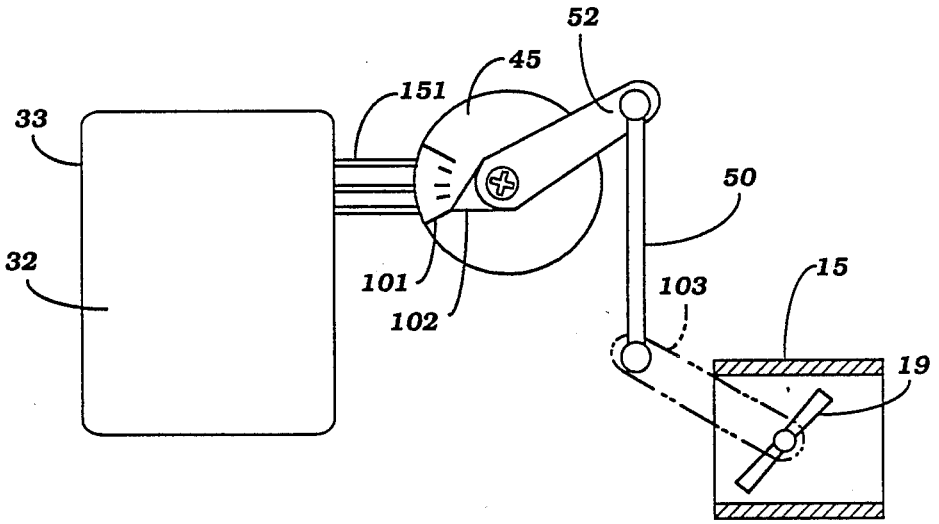
FIG. 8 is a side elevational view, in part similar to Figures 3 and 7, showing yet another embodiment of the invention.

FIG. 8 shows another embodiment of the invention wherein the throttle position sensing mechanism 45 is mounted away from the circuit board 36 and outside of the spark control box 33 and spark firing circuit 32. In this embodiment, the throttle position sensing mechanism 45 is connected by means of a connector 151 to the spark control circuit so as to provide the desired spark control. Specifically, the connection 151 should be one which cannot be disassembled so as to expose the junction portions. This device includes an adjusting mechanism for adjusting the position between throttle valve position 19 and shaft position 46 as shown in Figure 7.

Figure 9:
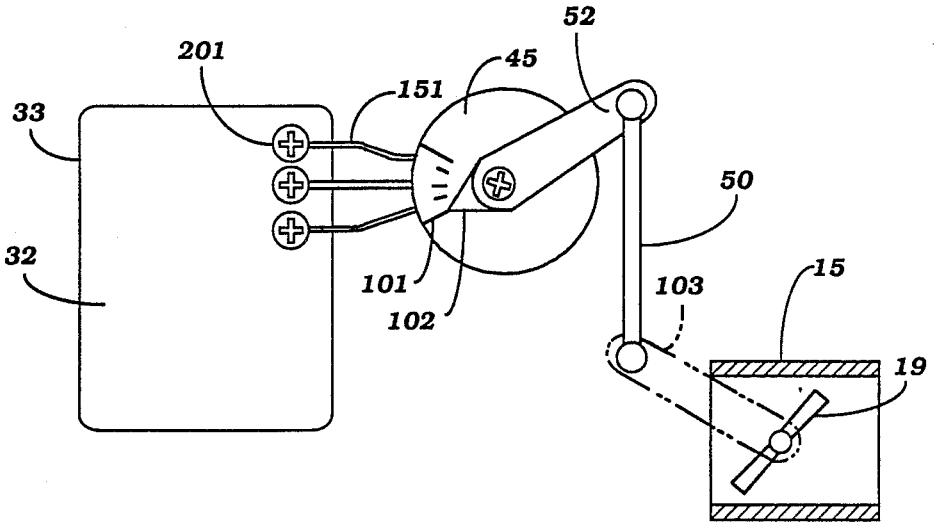
FIG. 9 is a side elevational view, in part similar to Figures 3, 7 and 8, showing a still further embodiment of the invention.

FIG. 9 shows an embodiment which is generally similar to the embodiment of FIG. 8. In this embodiment, however, the connections 151 are connected to respective terminals 201 through screws which are then painted in place so as to insure against tampering.

It should be readily apparent from the foregoing description that a number of embodiments of the invention have been illustrated and described and each of which provides adjustment of the spark timing without necessitating major reconstruction of the elements or disassembly of them. This adjustment is achieved through the translational mechanism which connects the throttle valve 19 with the input shaft of the throttle position indicating mechanism 45 and thus affords a simple mechanical adjustment without necessitating changing of the circuitry. Although a number of embodiments of the invention have been illustrated and described, various changes and modifications may be made without departing from the spirit and scope of the invention, as defined by the appended claims.

We claim:

1. An ignition control system for an internal combustion engine having an engine speed controlling element moveable through a predetermined range for controlling engine speed, position sensing means for sensing the position of said speed controlling element and an ignition circuit for controlling ignition timing including arithmetic advancing means moveable in a predetermined range for controlling the ignition timing in response to a signal from said position sensing means, the improvement comprising motion translating means for translating the movement of said speed controlling element of a magnitude into movement of said position sensing means at a different magnitude.

2. An ignition control system as set forth in claim 1 wherein the engine speed controlling element comprises a throttle valve.

3. An ignition control system as set forth in claim 1 wherein the position sensing means comprises a rotatable potentiometer.

4. An ignition control system for an internal combustion engine having an engine speed controlling element moveable through a predetermined range for controlling engine speed, position sensing means for sensing the position of said speed controlling element and an ignition circuit for controlling ignition timing including arithmetic advancing means moveable in a predetermined range for controlling the ignition timing in response to a signal from said position sensing means, the improvement comprising a linkage system for translating the movement of said speed controlling element into movement of said position sensing means at a predetermined ratio.

5. An ignition control system as set forth in claim 4 wherein the linkage system includes a cam and follower.

6. An ignition control system as set forth in claim 5 wherein the engine speed controlling element comprises a throttle valve.

7. An ignition control system as set forth in claim 6 wherein the position sensing means comprises a rotatable potentiometer.

* * * * *